US008622563B2

(12) United States Patent
Manners

(10) Patent No.: US 8,622,563 B2
(45) Date of Patent: Jan. 7, 2014

(54) MOVING LIGHT WITH REMOVABLE CIRCUIT BOARD

(75) Inventor: Robert Manners, Chappaqua, NY (US)

(73) Assignee: Production Resource Group, LLC, Windsor, NY (US)

( * ) Notice: Subject to any disclaimer, the term of this patent is extended or adjusted under 35 U.S.C. 154(b) by 1294 days.

(21) Appl. No.: 11/759,082

(22) Filed: Jun. 6, 2007

(65) Prior Publication Data

US 2007/0285204 A1 Dec. 13, 2007

Related U.S. Application Data

(60) Provisional application No. 60/813,122, filed on Jun. 12, 2006.

(51) Int. Cl.
*F21V 33/00* (2006.01)

(52) U.S. Cl.
USPC ..... 362/85; 362/275; 362/321

(58) Field of Classification Search
USPC ..... 362/85, 275, 283
See application file for complete search history.

(56) References Cited

U.S. PATENT DOCUMENTS

| | | | | |
|---|---|---|---|---|
| 4,701,833 | A * | 10/1987 | Bornhorst | 362/294 |
| 6,744,693 | B2 * | 6/2004 | Brockmann et al. | 362/321 |
| 6,902,302 | B2 * | 6/2005 | Foster | 362/324 |
| 6,926,427 | B2 * | 8/2005 | Tawil et al. | 362/321 |
| 2004/0095761 | A1 * | 5/2004 | Esakoff | 362/226 |
| 2004/0125602 | A1 * | 7/2004 | Hunt et al. | 362/293 |
| 2006/0019705 | A1 * | 1/2006 | Fukuda | 455/556.1 |
| 2006/0291237 | A1 * | 12/2006 | Richmond et al. | 362/564 |
| 2007/0130434 | A1 * | 6/2007 | Chu et al. | 711/163 |

* cited by examiner

*Primary Examiner* — Evan Dzierzynski
(74) *Attorney, Agent, or Firm* — Law Office of Scott C. Harris, Inc.

(57) ABSTRACT

A moving light which has a removable part that allows upgrading and retrofitting the moving light, but yet remains balanced. The removable part can be in a balanced location, for example on the center of gravity or center of symmetry of the light. Two separate removable parts can be in different locations, one of which balances out against the other. The parts can be circuit boards, memory chips, processor chips, or digital memory devices such as a type usable in digital cameras.

5 Claims, 2 Drawing Sheets

MOVING LIGHT WITH REMOVABLE CIRCUIT BOARD

CROSS-REFERENCE TO RELATED APPLICATIONS

This application claims priority to U.S. Provisional Application 60/813,122, filed Jun. 12, 2006. The disclosure of the prior application is considered part of (and is incorporated by reference in) the disclosure of this application.

BACKGROUND

It is conventional for moving lights to be controlled by electronic circuitry including computer circuitry. These moving lights may also include certain kinds and types of programs thereon. When the lights are operated, the hardware within the light itself controls certain actions of the light. For example, the light may be caused to move or to carry out some effect based on the hardware in the light.

Because these lights are caused to move, they must maintain balance. Designers carefully control the hardware in the light to maintain the balance of these lights so that the motors which move the lights can more easily and quickly carry out their intended functions of moving the light to pan and tilt directions.

Because of this, and because the lights are often packed into cases and shipped to various locations, these lights have conventionally had fixed circuit boards which were attached in a fixed manner. The only way to change the hardware was to 'retrofit' the light.

SUMMARY

A stage lighting system is described that has removable processing component(s). The stage lighting system has a housing, a bulb of all of at least 200 W, and at least one motor that enables moving the housing. There is a processing element in the housing, capable of carrying out a processing function, and also capable of receiving remote commands to move and/or carry out some other function of the light. The processing element includes a replaceable part which is located in the housing in a location that is balanced within the housing. This allows the light to move symmetrically, even after replacement of the circuit board

DETAILED DESCRIPTION

The general structure and techniques, and more specific embodiments which can be used to effect different ways of carrying out the more general goals, are described herein.

The embodiment is disclosed herein are intended to be used in a so-called "stage light" that is a light that uses a projection beam of at least 200 W, is controllable from a remote location to project that beam into a plurality of different areas by moving the beam; and is also controllable from a remote location to allow changing of at least one of the color or "look (e.g. a gobo) of the beam. The housing is typically movable in such a device, via pan and tilt motors.

First Embodiment

Figure 1:
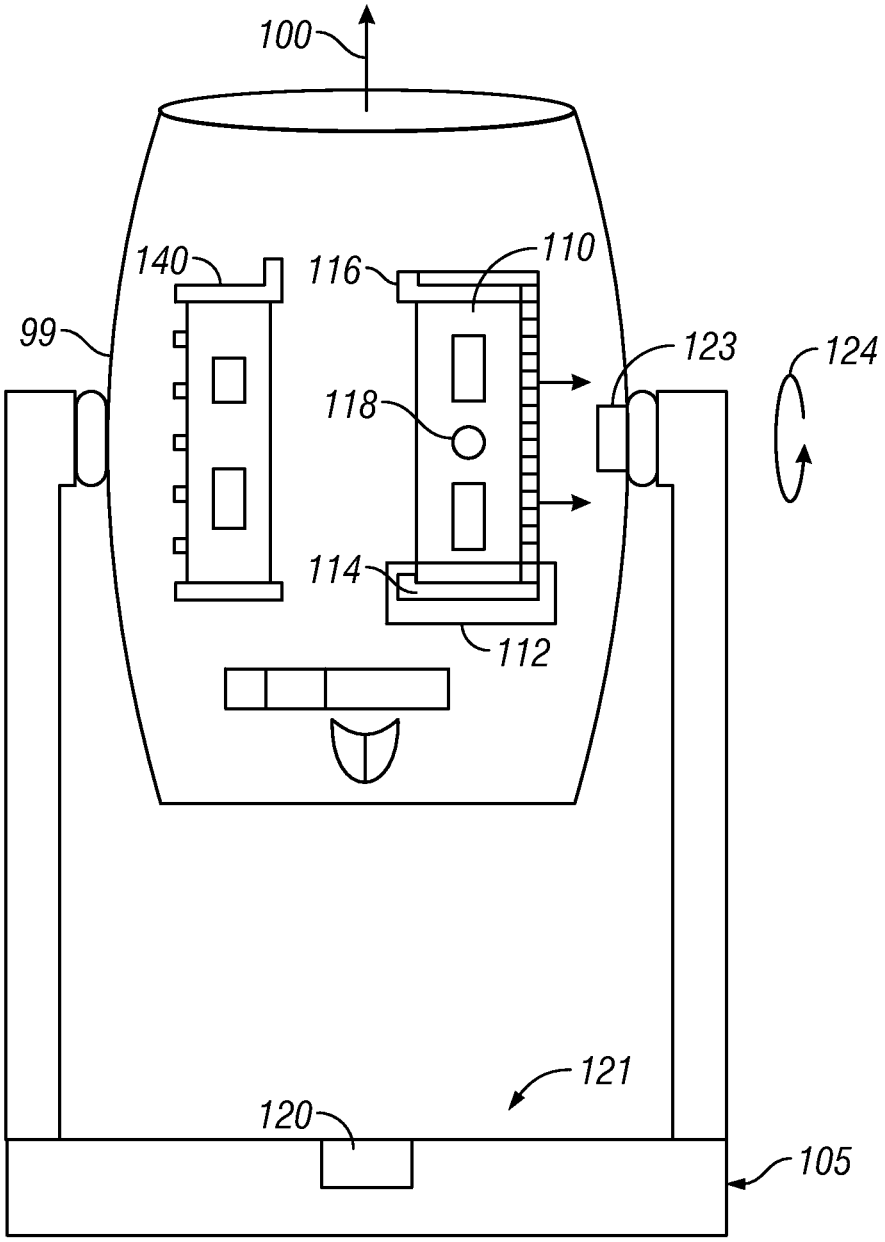
FIG. 1 shows a cutaway view of a moving light showing replaceable circuit boards that may be used.

FIG. 1 shows an embodiment of a cutaway version of the moving light. A first motor 120 may control pan of the light, that is movement in the direction generally shown by the arrow 121. Tilt of the light may be controlled by motor 123, which controls movement of the light in the direction shown by the arrow 124. By controlling pan and tilt, the light can be controlled to direct its optical beam 100 to any desired location. Lights of this type typically include communication capability, with a controlling line 105 providing control information, which is sent to an internal processor. The processor may control the type of movement. The internal processor may also control color of lights, gobos, as well as computer-controlled special effects.

Because the light must move, it is desirable to keep it balanced. According to this embodiment, the controlling circuitry is located on a circuit board 110. This circuit board is a removable circuit board, which has connections along an edge based connector 112. In the embodiment, the connector may be for example a connector of the PCI type or the like, and the connector may have a form factor of the type generally used in such PCI slots. When this form factor is used, the board has a first hook portion 114 which hooks under a support at one edge of the board. The other edge of the board 116 has a screw on portion, which screws through a generally angular piece of metal that holds the board into place. The connectors 112 are held into their corresponding connector by the force of the two screws. If desired, an additional screw hole 118 substantially in the center of the board may also be located. This screw hole may be connected to chassis ground, and can aid in maintaining the board in place.

The light itself 99 may be balanced to maintain the general shape and size of the board 110 in a balanced position. However, the board 110 can be easily removed and replaced to update the hardware on the board. Therefore, the different processing parts, including the main processor, as well as the supplemental processing parts, memory, programs, and the light, can be easily updated.

The board 110 is located in a location which is off of the optical axis 100, at a location that is spaced from the optical axis along an axis of the light that forms its wide axis (assuming that the light is widened at one area, rather than cylindrical).

Typical lights of this type may produce between 200 and 900 W of illumination power. The board is maintained spaced from that heat as much as possible to prevent heat effects from the optical beam.

Second Embodiment

In a second embodiment, there is a second board 140. Preferably the two boards have substantially comparable hardware profiles, and balance relative to one another. Both of the boards are the same type of boards and can be replaced in the same way. In this way, if heavier or lighter components are used on either board, comparable components can be used on the other board to maintain balance in the system.

Third Embodiment

Figure 2:
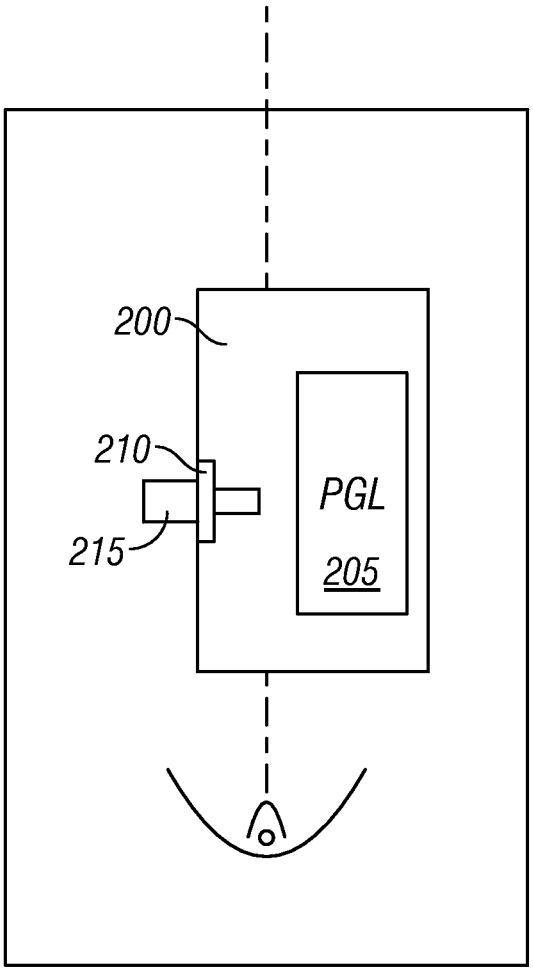
FIG. 2 shows a second embodiment with configuration via memory.

According to a third embodiment, the board which includes the circuitry controlling the various parameters can be electrically reconfigured. The board 200 is shown in FIG. 2. The board is shown as including programmable logic 205. A slot 210, for example receives a USB or other flash memory 215, or a memory stick or other removable memory intended for digital camera use. A program on the removable memory 215 allows reconfiguration of the programmable logic. This allows more advanced functions, or different kinds or functions of circuits to be obtained. For example, the programmable logic can be reconfigured to form more complex DSPs as the processing power of the light needs to increase.

In addition, the programmable logic board 205 can itself be upgraded with either more advanced circuits, or with more circuitry or more advanced circuitry. In an embodiment, for example, the circuitry can be replaceable such as an FPGA that is located in a removable and replaceable socket. The removable and replaceable circuitry can be located in a symmetrical location within the light, that is a location where the different parts of the circuit can balance against one another, or alternatively can be located in pairs, with the different pairs offsetting one another in a way that enables balancing them.

The above describes control carried out by the circuits. The control may be control of digital functions of the light, projector functions, projection of video, control of associated functions such as motors, or colors, and others.

Although only a few embodiments have been disclosed in detail above, other embodiments are possible and the inventor intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other kinds of removable memory can be used.

Also, the inventor intends that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The computer may be an Intel (e.g., Pentium or Core 2 duo) or AMD based computer, running Windows XP or Linux, or may be a Macintosh computer. The computer may also be a handheld computer, such as a PDA, cellphone, or laptop.

The programs may be written in C or Python, or Java, Brew or any other programming language. The programs may be resident on a storage medium, e.g., magnetic or optical, e.g. the computer hard drive, a removable disk or media such as a memory stick or SD media, wired or wireless network based or Bluetooth based Network Attached Storage (NAS), or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A stage lighting system, comprising:

stage lighting components including a housing, a bulb of at least 200 W, and at least one motor that enables moving the housing, and at least one processing element, capable of carrying out a processing function, and also capable of receiving remote commands which indicate operation to be carried out by said stage lighting components; wherein said at least one processing element includes a replaceable part which is located in said housing in a location that is balanced within said housing, wherein said replaceable part includes a programmable device that can be replaced with a different programmable device; wherein said replaceable part includes first and second parts, located in different locations which balance against one another.

2. A system as in claim 1, wherein said first and second parts have comparable geometric profiles to one another.

3. A method, comprising:

projecting light using a stage light;

remotely commanding said stage light to move between different positions of projection, including commanding the light to pan using a first motor to drive the pan, and to tilt using a second motor to drive the tilt; and retrofitting said stage light by replacing at least one processing element within said stage light, wherein said at least one processing element is at a location that is balanced relative to said stage light; wherein said replacing comprises replacing at least one chip with programmable logic thereon; wherein said replacing at said at least one chip comprises replacing at least two chips that are in balanced locations relative to one another.

4. A method, comprising:

projecting light using a stage light;

remotely commanding said stage light to move between different positions of projection, including commanding the light to pan using a first motor to drive the pan, and to tilt using a second motor to drive the tilt; and retrofitting said stage light by replacing at least one processing element within said stage light, wherein said at least one processing element is at a location that is balanced relative to said stage light; wherein said replacing comprises replacing at least one circuit board; wherein said replacing comprises replacing two circuit boards which are located in symmetrical locations relative to one another.

5. A method as in claim 4, wherein said two circuit boards are boards that have comparable hardware profiles.

* * * * *